US009799986B2

(12) United States Patent
Wu et al.

(10) Patent No.: US 9,799,986 B2
(45) Date of Patent: Oct. 24, 2017

(54) CABLE CONNECTOR ASSEMBLY HAVING IMPROVED OUTER SHELL AND LATERAL MATING MEMBER

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/186,799

(22) Filed: Jun. 20, 2016

(65) Prior Publication Data

US 2016/0372857 A1 Dec. 22, 2016

(30) Foreign Application Priority Data

Jun. 18, 2015 (CN) ..... 2015 1 0339222
Feb. 16, 2016 (CN) ..... 2016 1 0086923
Feb. 16, 2016 (CN) ..... 2016 1 0086924

(51) Int. Cl.

| | |
|---|---|
| ***H01R 13/58*** | (2006.01) |
| ***H01R 13/717*** | (2006.01) |
| *H01R 107/00* | (2006.01) |
| *H01R 13/502* | (2006.01) |
| *H01R 13/6593* | (2011.01) |
| *H01R 13/6594* | (2011.01) |

(52) U.S. Cl.
CPC ..... *H01R 13/5825* (2013.01); *H01R 13/7172* (2013.01); *H01R 13/7175* (2013.01); *H01R 13/502* (2013.01); *H01R 13/5816* (2013.01); *H01R 13/6593* (2013.01); *H01R 13/6594* (2013.01); *H01R 2107/00* (2013.01)

(58) Field of Classification Search
CPC ..... H01R 13/502; H01R 13/5816; H01R 13/6593; H01R 13/7175
USPC ..... 439/465, 607.56, 731, 906, 680, 490
See application file for complete search history.

(56) References Cited

U.S. PATENT DOCUMENTS 4,963,104 A * 10/1990 Dickie ..... H01R 9/0524 439/460
5,188,542 A * 2/1993 Ballman ..... H01R 13/6691 439/465

(Continued)

FOREIGN PATENT DOCUMENTS

CN 202564673 11/2012

*Primary Examiner* — Tho D Ta
(74) *Attorney, Agent, or Firm* — Wei Te Chung; Ming Chieh Chang

(57) ABSTRACT

A cable connector assembly (100) includes a mating member (10) adapted to be mated with a mating connector, a cable (20) electrically connected with the mating member, a strain relief member (30) enclosing the cable, and an outer shell (40) assembled at outer sides of the mating member and the strain relief member. The outer shell includes a first shell (41) and a second shell (42) mated with the first shell. The strain relief member includes a mating portion (31) enclosed by the outer shell and a ring portion (32) connected with the mating portion. Both of the first shell and the second shell are latched with the mating portion.

15 Claims, 12 Drawing Sheets

(56) References Cited

U.S. PATENT DOCUMENTS

| | | | | | |
|---|---|---|---|---|---|
| 5,941,725 | A * | 8/1999 | Brennan | H01R 13/65802 | 439/357 |
| 6,062,895 | A * | 5/2000 | Lin | H01R 4/2429 | 439/404 |
| 6,083,031 | A * | 7/2000 | Kuo | H01R 13/6215 | 439/362 |
| 6,106,325 | A * | 8/2000 | Kuo | H01R 13/5808 | 439/455 |
| 6,165,006 | A * | 12/2000 | Yeh | H01R 13/6641 | 439/490 |
| 6,416,351 | B1 * | 7/2002 | Ho | F21V 27/02 | 439/447 |
| 7,040,916 | B2 * | 5/2006 | Schmidt | H01R 13/5205 | 439/455 |
| 7,722,363 | B2 * | 5/2010 | Zhou | H01R 12/515 | 439/490 |
| 8,113,869 | B2 * | 2/2012 | Su | H01R 13/5816 | 439/455 |
| 8,911,263 | B2 * | 12/2014 | Becavin | H01R 13/64 | 439/680 |
| 2013/0147058 | A1 * | 6/2013 | Yu | H01L 23/5389 | 257/774 |
| 2013/0164969 | A1 * | 6/2013 | Wu | H01R 13/582 | 439/460 |

* cited by examiner

CABLE CONNECTOR ASSEMBLY HAVING IMPROVED OUTER SHELL AND LATERAL MATING MEMBER

BACKGROUND OF THE INVENTION

1. Field of the Invention

The present invention relates to a cable connector assembly, and more particularly to a cable connector assembly having an outer shell.

2. Description of Related Arts

China Patent No. 202564673, issued on Nov. 28, 2012 to Wu et al., discloses a cable connector assembly comprising a mating member, a cable electrically connected with the mating member, a printed circuit board electrically connected between the mating member and the cable, a strain relief member disposed at an outer side of the cable, an insulative shell disposed at outer sides of the cable and the strain relief member, a LED mounted on the printed circuit board, and a light guide member mounted on the printed circuit board and guiding the light emitting from the LED to an outer side of the insulative housing for a user to observe. The insulative shell comprises a bottom shell and an upper shell mated with the bottom shell. A retaining force between the insulative shell and the strain relief member is weak.

Hence, an improved cable connector assembly is desired to offer advantages over the related art.

SUMMARY OF THE INVENTION

An object of the present invention is to provide an cable connector assembly having an outer shell stably connected with a strain relief member.

To achieve the above-mentioned object, a cable connector assembly comprises: a mating member adapted to be mated with a mating connector; a cable electrically connected with the mating member; a strain relief member enclosing the cable; and an outer shell assembled at outer sides of the mating member and the strain relief member, the outer shell comprising a first shell and a second shell mated with the first shell; wherein the strain relief member comprising a mating portion enclosed by the outer shell and a ring portion connected with the mating portion; and wherein both of the first shell and the second shell are latched with the mating portion.

According to the present invention, the first shell and the second shell are latched with the mating portion of the strain relief member. Therefore, the outer shell is stably connected with the strain relief member.

Another object of the present invention is to provide a cable connector assembly having an improved light guide member.

To achieve the above-mentioned object, a cable connector assembly comprises: an outer shell comprising a plurality of side walls and a receiving space surround by the side walls, one of the side walls defining a through hole in communication with the receiving space; a light guide member received in the outer shell, the light guide member comprising a mounting portion, a guide portion extending outwardly from a side of the mounting portion and received in the through hole, and a recess portion recessed inwardly from a side of the mounting portion; a printed circuit board received in the receiving space; and a light member mounted on the printed circuit board; wherein the mounting portion is glued onto the side wall which defines the through hole, and the recess portion is adapted to receive over-flowing glue.

According to the present invention, the mounting portion of the light guide member of the light guide member defines a recess portion recessed used to receive the over flowing glue. Therefore, the over flowing glue will not affect light guiding function of the light guide member.

DETAILED DESCRIPTION OF THE PREFERRED EMBODIMENT

Reference will now be made in detail to a preferred embodiment of the present invention.

Figure 1:
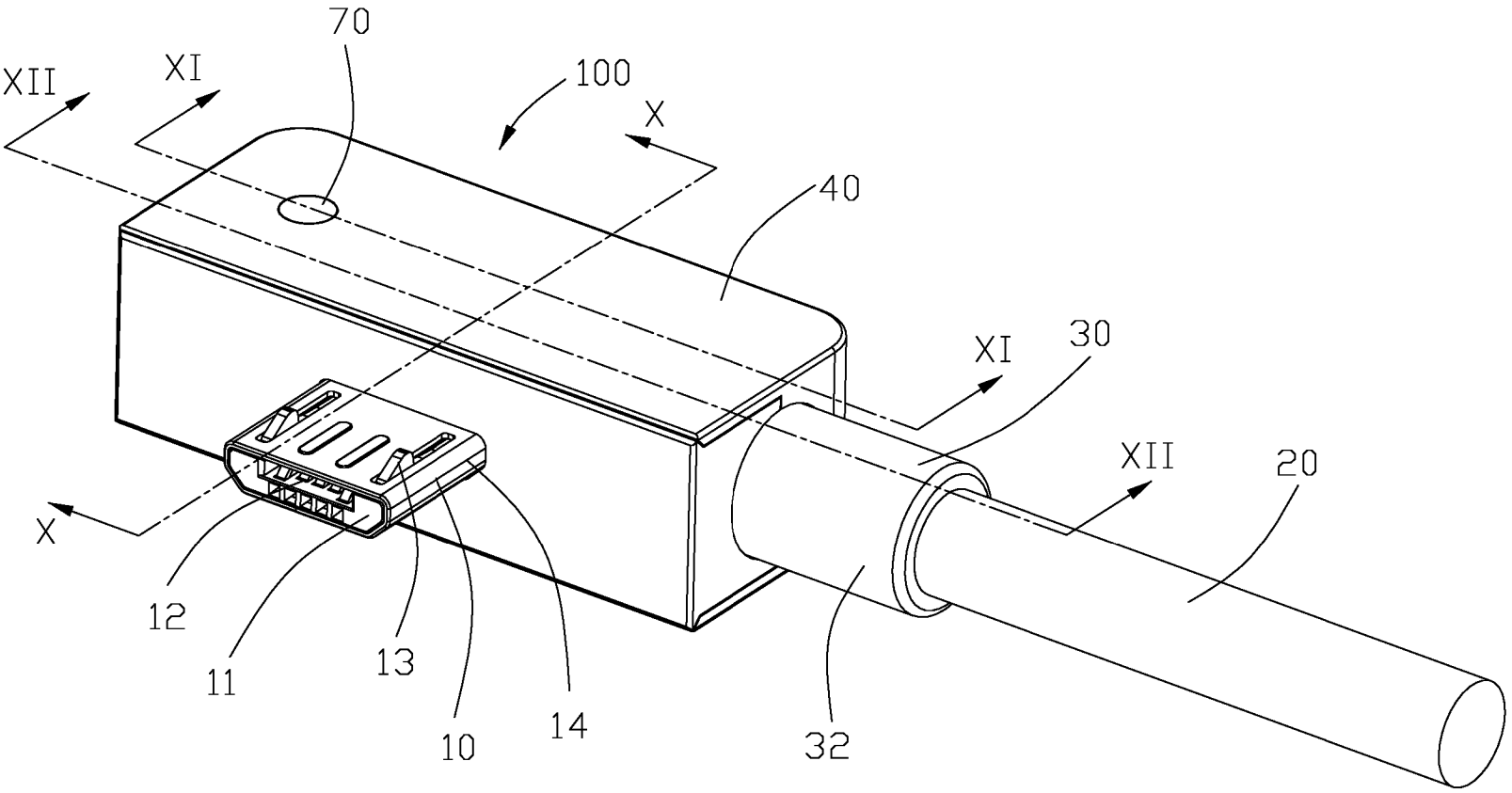
FIG. 1 is a perspective view of a cable connector assembly in accordance with present invention.
Figure 2:
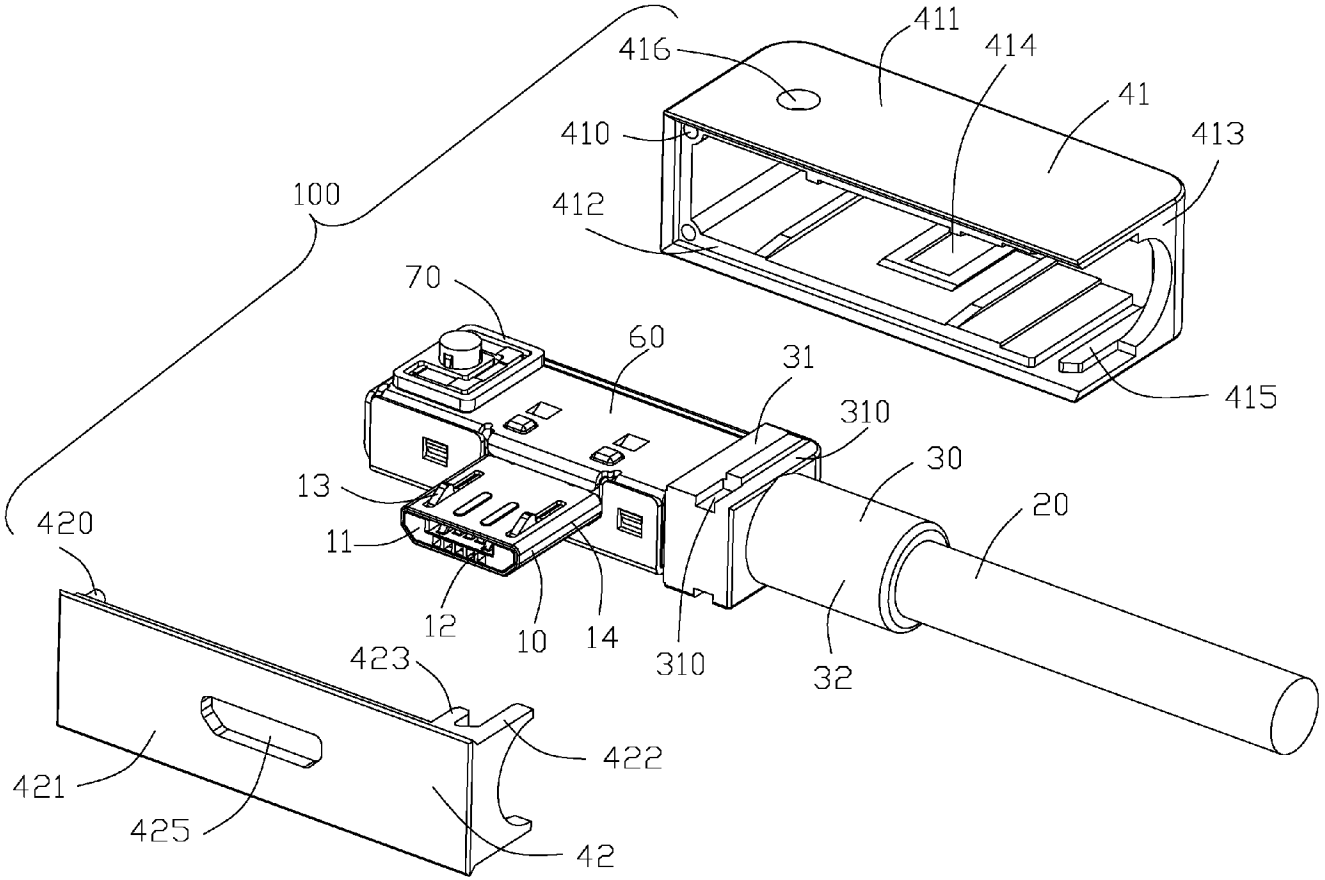
FIG. 2 is a partly exploded view of the cable connector assembly as shown in FIG. 1.
Figure 3:
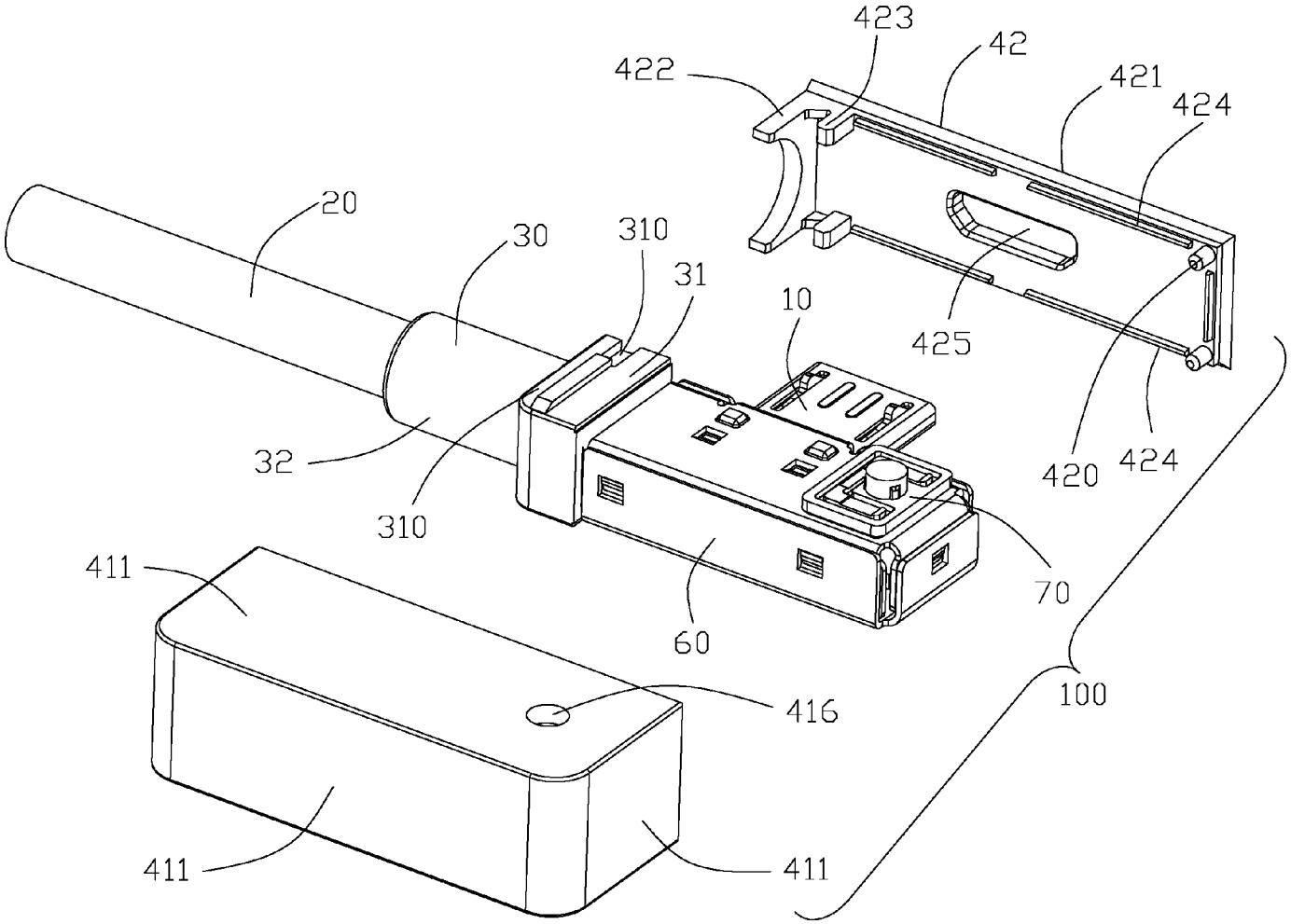
FIG. 3 is another partly exploded view of the cable connector assembly as shown in FIG. 2.
Figure 4:
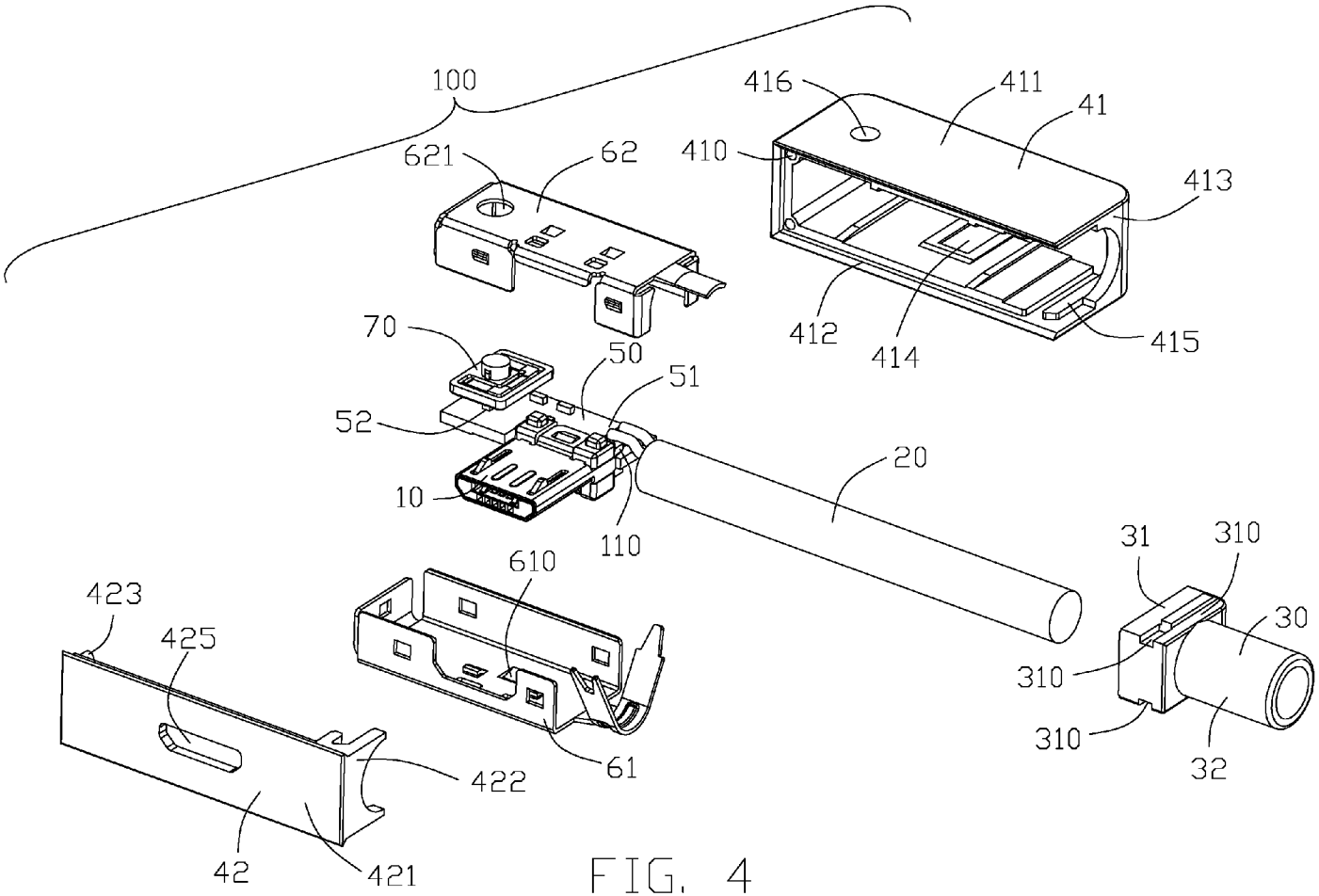
FIG. 4 is an exploded view of the cable connector assembly as shown in FIG. 1.
Figure 5:
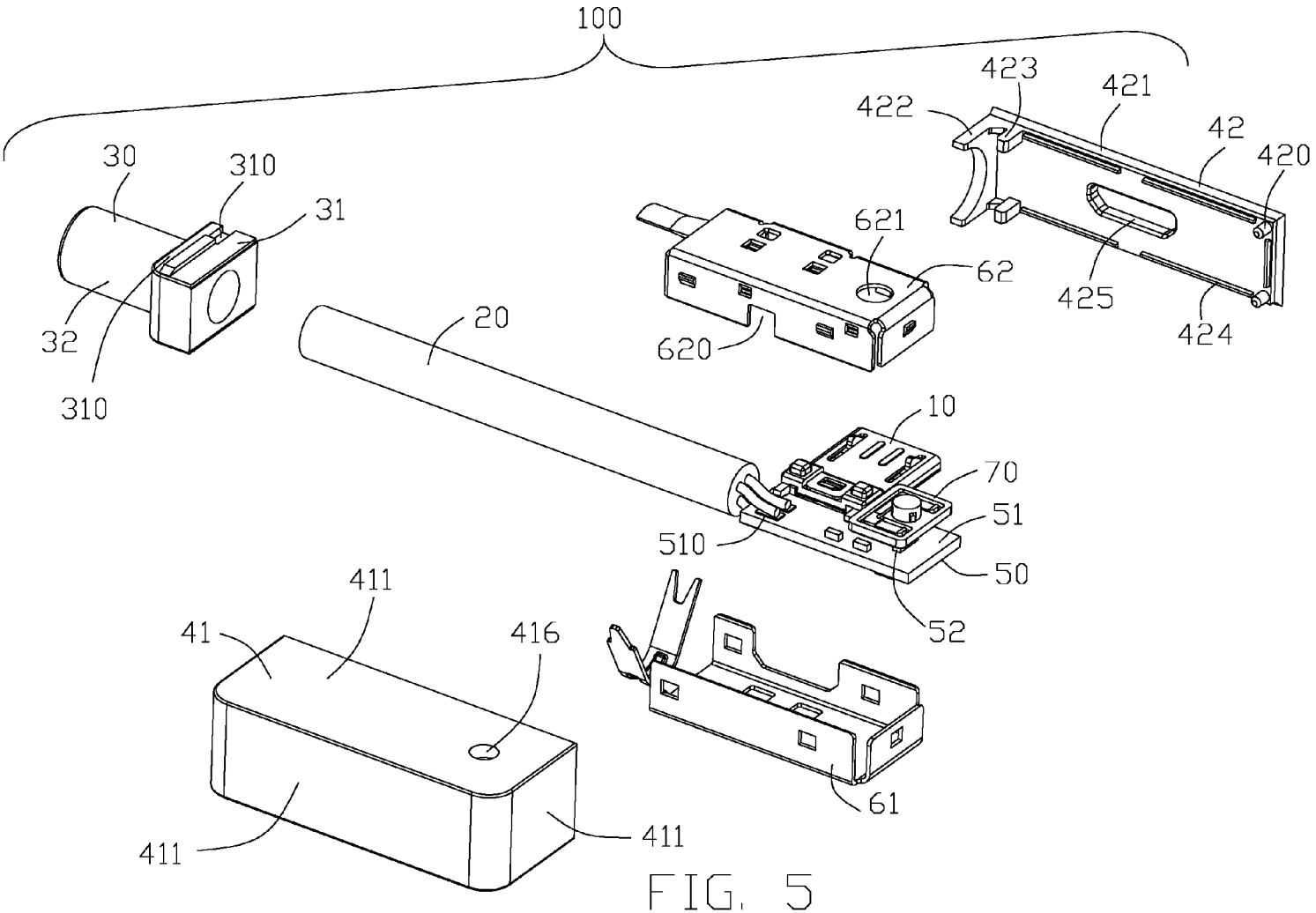
FIG. 5 is another exploded view of the cable connector assembly as shown in FIG. 4.
Figure 6:
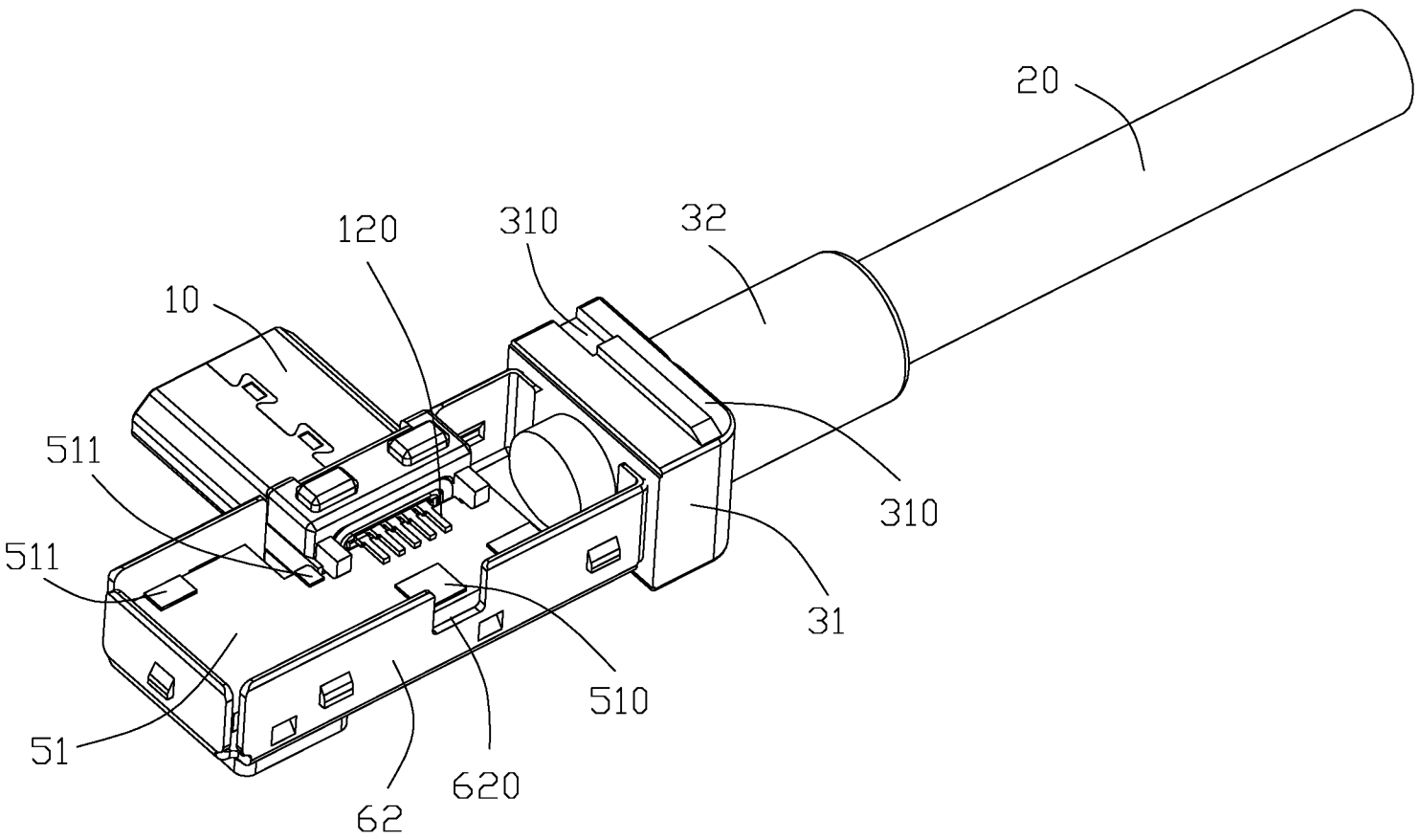
FIG. 6 is a perspective view of the cable connector assembly with an outer shell and an upper metal shell removed as shown in FIG. 1.
Figure 7:
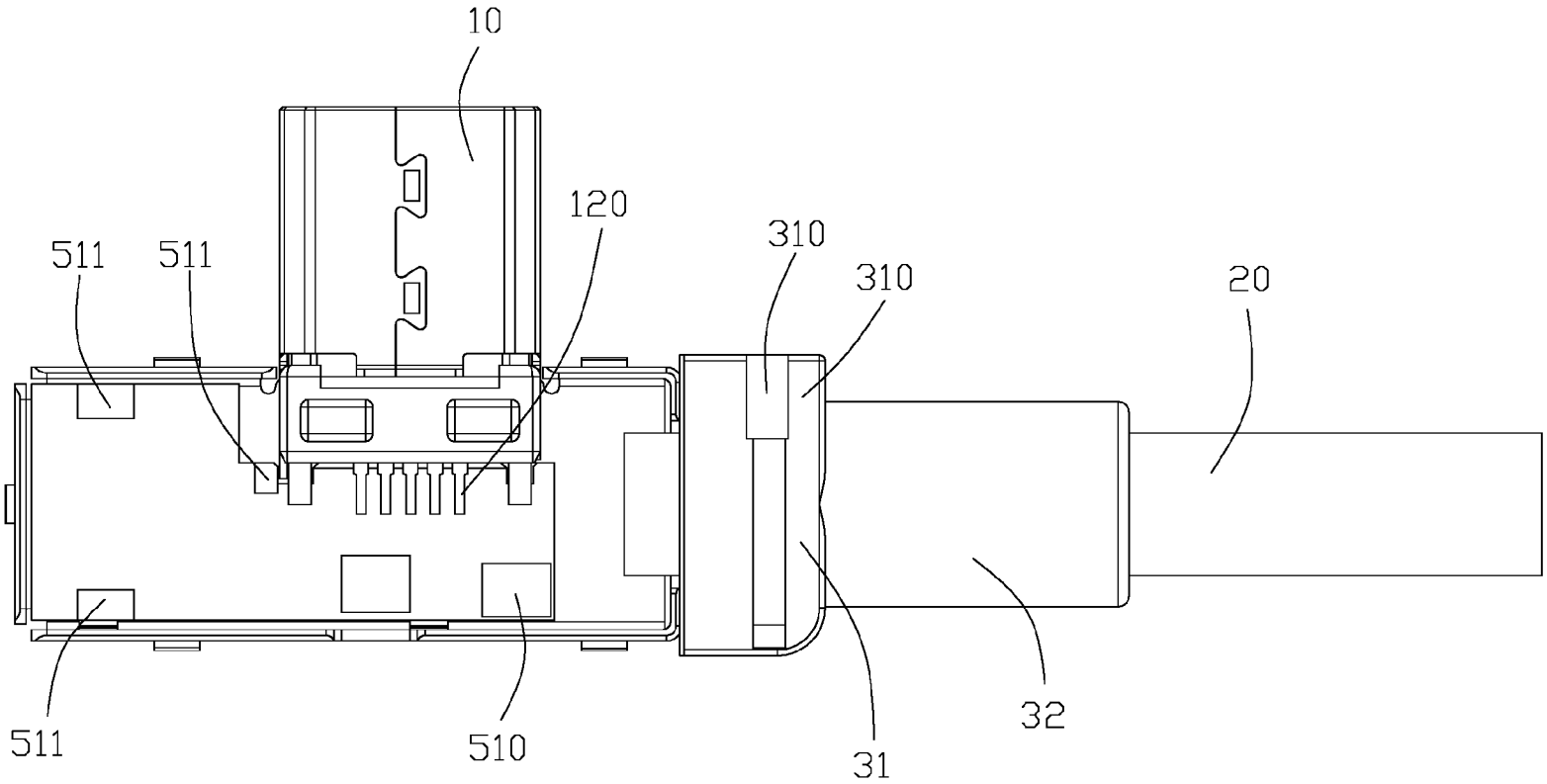
FIG. 7 is a top view of the cable connector assembly as shown in FIG. 6.
Figure 8:
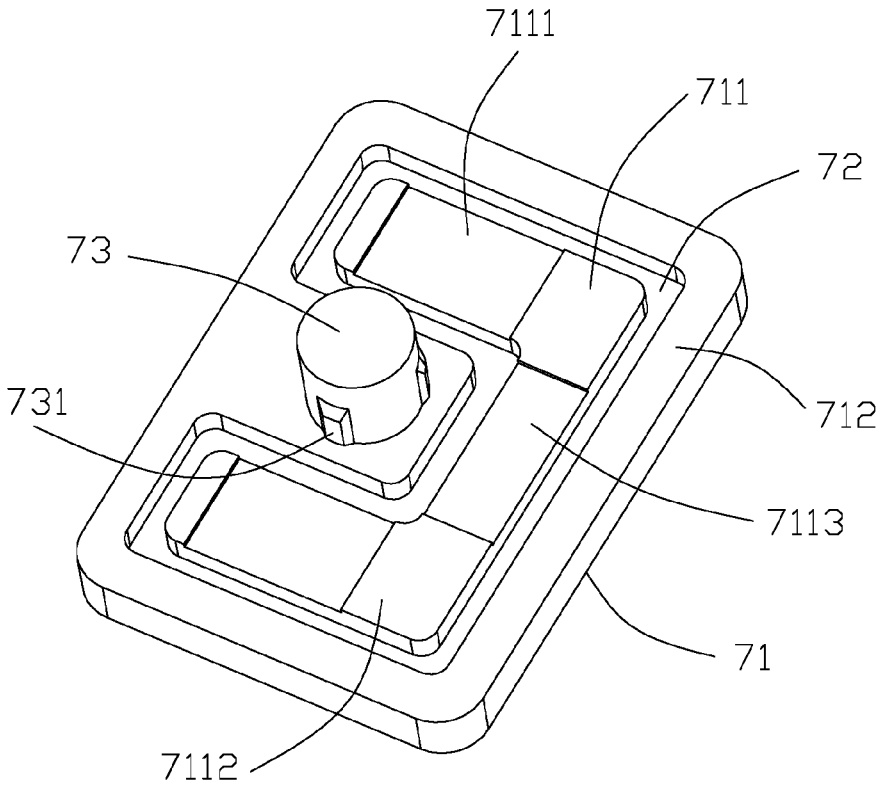
FIG. 8 is a perspective view of a light guide member of the cable connector assembly as shown in FIG. 1.
Figure 9:
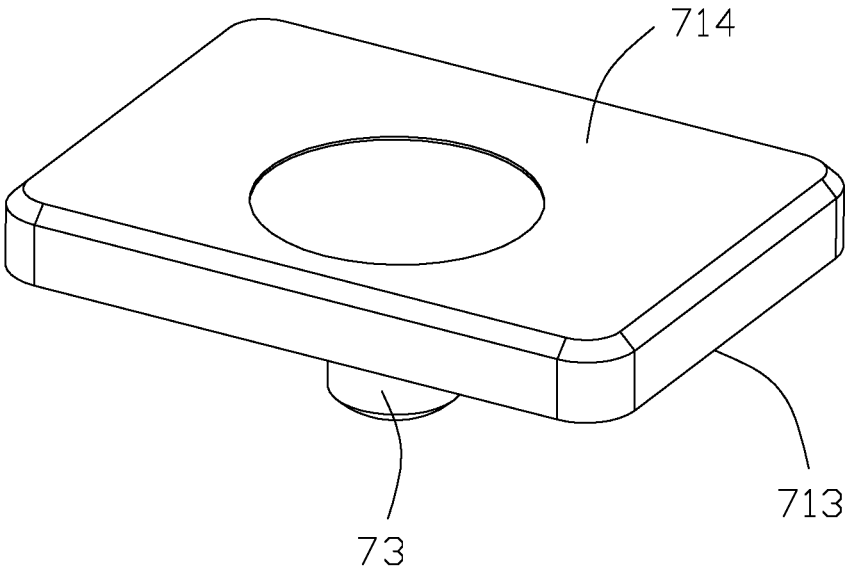
FIG. 9 is another perspective view of a light guide member as shown in FIG. 8.
Figure 10:
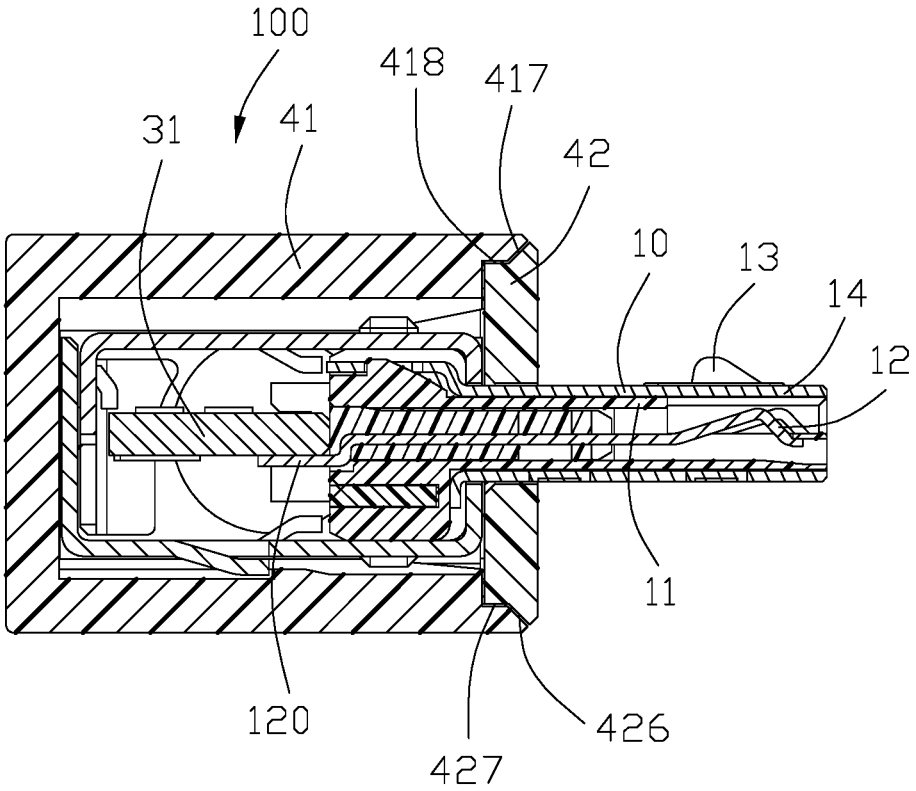
FIG. 10 is a cross-sectional view of the cable connector assembly taken along line 10-10 in FIG. 1.
Figure 11:
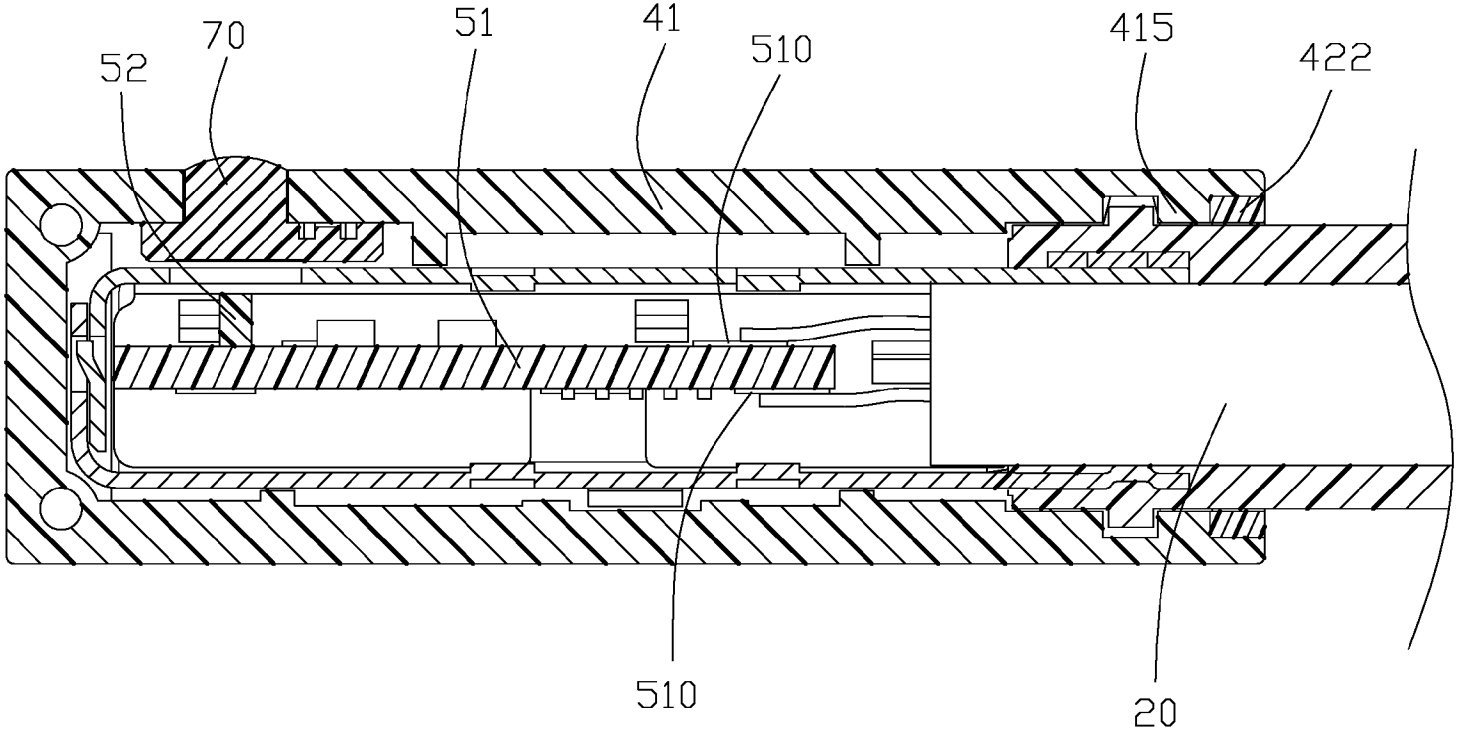
FIG. 11 is a cross-sectional view of the cable connector assembly taken along line 11-11 in FIG. 1.
Figure 12:
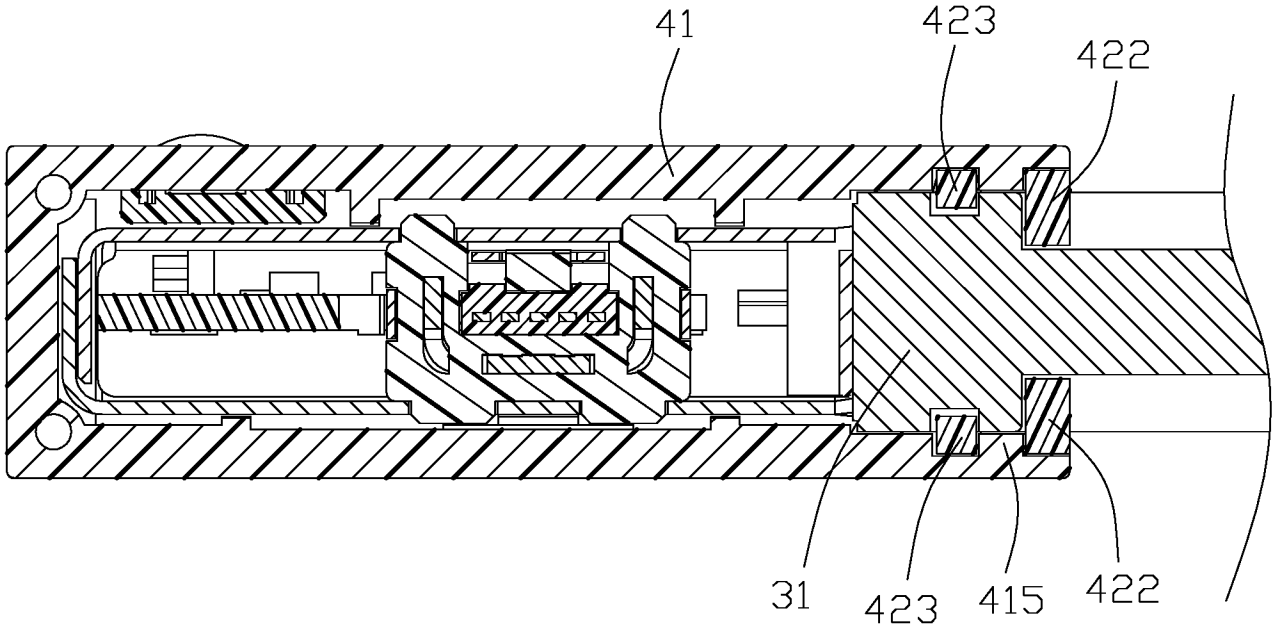
FIG. 12 is a cross-sectional view of the cable connector assembly taken along line 12-12 in FIG. 1.

Referring to FIGS. 1 to 12, a cable connector assembly 100 comprises a mating member 10 adapted to be mated with a mating connector, a cable 20 electrically connected with the mating member 10, a strain relief member 30 enclosing the cable 20, and an outer shell 40 assembled at outer sides of the mating member 10 and the strain relief member 30. The cable connector assembly further comprises a print circuit board assembly 50 electrically connected with the cable 20 and the mating member 10, a metal shell 60 disposed between the outer shell 40 and the mating member 10, and a light guide member 70 disposed between the outer shell 40 and the metal shell 60.

Referring to FIGS. 1-7 and 10-12, in this embodiment, the mating member is according with USB 2.0 Micro B standard, or other suitable standard. The mating member 10 comprises an insulative housing 11, a plurality of contacts 12 received and fixed in the insulative housing 11, a pair of latch members 13 received in the insulative housing 11 and disposed at two opposite sides of the contacts 12 respectively, and an outer metal shell 14 disposed at an outer side of the insulative housing 11. The latch members 13 are extend beyond the outer metal shell 14. The insulative housing 11 defining a pair of rear grooves 110 at a rear portion. Each of the contacts 12 comprises a soldering portion 120 extending beyond the rear portion of the insulative housing.

Referring to FIGS. 1-7 and 11-12, the strain relief member 30 comprises a mating portion 31 enclosed by the outer shell 40 and a ring portion 32 connected with the mating portion 31. The mating portion 31 has a rectangle cross section. The mating portion 31 defines a pair of slots 310 in upper side and a pair of slots 310 in bottom side. Both of the two pairs of slots 310 are offset with each other.

Referring to FIGS. 1-5 and 10-12, the outer shell 40 comprises a plurality of side walls and a receiving space surround by the side walls. The outer shell 40 comprises first shell 41 and a second shell 42 mated with the first shell 41. The first shell 41 defines a pair locating holes 410. The second shell 42 comprises a pair locating posts 420 mated with the locating holes 410, respectively. Both of the first shell 41 and the second shell 42 are latched with the mating portion 31. The first shell 41 comprises four closed walls 411, one opened wall 412 and one notched wall 413. A recess 414 is defined on a bottom of the closed walls 411. A plurality of ribs 415 are disposed at a top and the bottom of the closed walls 411, the ribs 415 latched with the slots 310 of the mating portion 31, respectively. A through hole 416 is defined at the top of the closed walls 411 an in communication with the receiving space. The light guide member 70 extends through the through hole 416 to an outer side of the outer shell 40. The notched wall 413 has a U shape cross section. The second shell 42 comprises a flat portion 421 covering the opening wall 412, notched portion 422 vertically extending from an end of the flat portion 421, and a pair of projected ribs 423 vertically extending from the end of the flat portion 421 and spaced apart from the notched portion 422. The notched portion 422 has a U shape cross section. The projected ribs 423 are latched with the slots 310 of the mating portion 31, respectively. The projected ribs 423 extending a length along the direction perpendicular to the flat portion 421 are less than the notched portion 422 along the direction. The notched portion 422 and the notched wall 413 are cooperated to seal an outer side of the ring portion 32. Therefore, the outer shell 40 has a strong enough retain force with the strain relief member 30. The second shell 42 comprises a plurality of weld zones 424 in discontinuous arrangement in an inner side of the flat portion 421. The second shell 42 is fused with the first shell 41 by the weld zones 424 that will ensure no gap between the first shell 41 and the second shell 42. The flat portion 421 defines a mounting hole 425 that will make the mating member 10 extending beyond the flat portion 421 to be mated with the mating connector. The first shell 41 comprises a first inclined surface 417 extending inwardly, and the second shell 42 comprises a second surface 426 extending inwardly and mated with the first inclined surface 417. The first shell 41 comprises a first vertically surface 418 connected with the first inclined surface 417, and the second shell 42 comprises a second vertically surface 427 connected with the second inclined surface 426, the first vertically surface 418 mated with the second vertically surface 427. The first shell 41 and the second shell 42 are latched with the mating portion 31 of the strain relief member 30. Therefore, the outer shell 40 is stably connected with a strain relief member 30 and the cable 20.

Referring to FIGS. 4-7 and 10-12, the printed circuit board assembly 50 comprises a printed circuit board 51 received in the receiving space, and a light member 52 mounted on the printed circuit board 51. The light emitting form the light member 52 is transmitted to the outer side of the outer shell 40 by the light guide member 70 for user to observe the status of the cable connector assembly 100. The printed circuit board 51 is received in the rear grooves 110 and soldered with the soldering portions 120 of the contacts 12. The printed circuit board 51 comprises a plurality of conductive pad 510 for being soldered with the cable 20, and a plurality of soldering pads 511 for being soldered with the outer metal shell 14 of the mating member 10 and the metal shell 60.

Referring to FIGS. 2-7 and 10-12, the metal shell 60 comprises a bottom shell 61 and an upper shell 62 assembled with the bottom shell 61. The printed circuit board 51 and the light member 52 are received in the metal shell 60. The bottom shell 61 comprises a spring tab 610 extending upwardly and inclinedly to be latched with the recess 414 that will fix the metal shell 60. The upper shell 62 defines a through hole 620 adjacent to a portion of the printed circuit board 51 soldered with the cable 20 to prevent a soldered area of soldering pads 511 of the printed circuit board 51 and the cable 20 short connected with the metal shell 60. The upper shell 62 defines a light transmitting hole 621 that make the light pass through the metallic shell 60.

Referring to FIGS. 2-5, 8-9, and 11, the light guide member 70 is positioned on an upper outer surface of the metal shell 60. The light guide member 70 comprises a mounting portion 71, a guide portion 73 extending outwardly from a side of the mounting portion 71 and received in the through hole 416 of the outer shell 40, and a recess portion 72 recessed inwardly from the side of the mounting portion 71. The mounting portion 71 is assembled on the side wall 411 which defines the through hole 416 by glue, the recess portion 72 used to receive the over flowing glue so that the glue will not affect the guide portion 73. The mounting portion 71 comprise a first bulge portion 711 and a second bulge portion 712 divided by the recess portion 72. The first bulge portion 711 has a U shaped cross section. The mounting portion 71 comprises a top surface 713 and a bottom surface 714 opposite to the top surface 713. The bottom surface 714 is faced to the light member 52. The first bulge portion 711 and the second bulge portion 712 are defined in the top surface 713. The first bulge portion 711 defines a plurality of glue receiving portions 7111 recessed inwardly. Depths of the glue receiving portions are less than a depth of the recess portion 72. The first bulge portion 711 comprises a pair of side portions 7112 parallel to each other, and a middle portion 7113 connected with the pair of side portions 7112. Each of the side portions 7112 and the middle portion 7113 defines one of the glue receiving portions 7111. The guide portion 73 is disposed at the second bulge portion 712. The guide portion 713 comprises a plurality of interference ribs 731 to interference mate with the outer shell 40. The interference ribs 731 are arranged with corresponding glue receiving portions 7111. The light transmitting hole 621 has a diameter larger than a diameter of the light guide member 73. The light guide member 73 is arranged align with the light transmitting hole 621. The light guide member 73 extends through the through hole 416 to an outer side of the outer shell 40. One feature of the invention is to have the mating member 10 extend parallel to the printed circuit board 51 around one lateral side of the printed circuit board 51 and have the wires of the cable 20 soldered upon the printed circuit board 51 behind the mating member 10 in the transverse direction. On the other hand, the light member 52 and the associated light guide member 70 are located in front of the mating member 10 in the front-to-back direction, wherein the metal shell 60 encloses the printed circuit board 51 with a through hole to have the light communicate between the light member 52 and the light guide member 70. Notably, the rear end tabs (not labeled) of the shell 60 are embedded within the strain relief member 30 for securing the shell 60 with the cable 20. In addition, on one hand the shell 60 includes openings (not labeled) to receive the projections (not labeled) of the mating member 10 and the tabs (not labeled) to abut against the mating member, and on the other hand the shell 60 includes tabs (not labeled) to abut against the outer cover 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising: an insulative outer shell comprising a plurality of side walls and a receiving space surrounded by the side walls, one of the side walls defining a first through hole in communication with the receiving space;

a printed circuit board received in the receiving space with a light member thereon;

a metallic shell enclosing said printed circuit board and configured to be assembled into the receiving space relatively in a transverse direction and snugly received in the receiving space, and defining a second through hole aligned with the light member in a vertical direction perpendicular to said printed circuit board;

a mating member mounted upon a lateral side of the printed circuit board, the mating member having a mating opening extending in said transverse direction perpendicular to said vertical direction;

a cable with a plurality of wires soldered upon the printed circuit board; and a light guide member located between the outer shell and the metallic shell in said vertical direction and comprising a guide portion received in the first through hole; wherein the light guide member receives light from the second through hole and transmits said light to the guide portion in the first through hole.

2. The cable connector assembly as claimed in claim 1, wherein said mating member extends parallel to said printed circuit board.

3. The cable connector assembly as claimed in 1, wherein the plurality of wires are soldered upon the printed circuit board behind the mating member in said transverse direction, and said light member is located in front of the mating member in a front-to-back direction perpendicular to both said vertical direction and said transverse direction and opposite to said cable.

4. The cable connector assembly as claimed in claim 1, wherein said metallic shell includes means to secure to the mating member and means to secure to the outer shell.

5. The cable connector assembly as claimed in claim 1, wherein the insulative outer shell comprises a first shell and a second shell mated with the first shell, the second shell includes a flat portion having a mounting hole, and the mating member extends though the mounting hole.

6. A cable connector assembly comprising:

an insulative outer shell including a first shell and a second shell configured to be assembled to each other in a transverse direction and commonly defining a receiving space in said outer shell, one of said first shell and said second shell defining a first through hole in communication with the receiving space;

a printed circuit board received in the receiving space with a light member thereon a metallic shell snugly enclosed in the receiving space and including an upper shell and a bottom shell configured to be assembled to each other in a vertical direction perpendicular to both said printed circuit board and said transverse direction to enclose said printed circuit board, the upper shell defining a second through hole aligned with the light member in the vertical direction; and a light guide member located between the outer shell and the metallic shell in said vertical direction and comprising a guide portion received in the first through hole; wherein the light guide member receives light from the second through hole and transmits said light to the guide portion in the first through hole.

7. The cable connector assembly as claimed in claim 6, wherein said light guide member is attached to said one of the first shell and said second shell before the metallic shell is assembled into the receiving space relatively in the transverse direction.

8. The cable connector assembly as claimed in claim 6, further including a mating member mounted upon a lateral side of the printed circuit board, wherein said mating member extends parallel to said printed circuit board with a mating opening extending in said transverse direction.

9. The cable connector assembly as claimed in 8, further including a cable with a plurality of wires soldered upon the printed circuit board behind the mating member in said transverse direction, and said light member is located in front of the mating member in a front-to-back direction perpendicular to both said vertical direction and said transverse direction and opposite to said cable.

10. The cable connector assembly as claimed in claim 8, wherein. said metallic shell includes means to secure to the mating member and means to secure to the outer shell.

11. A cable connector assembly comprising:

an insulative outer shell comprising a plurality of side walls and a receiving space surrounded by the side walls, one of the side walls defining a first through hole in communication with the receiving space;

a printed circuit board received in the receiving space with a light member thereon;

a metallic shell enclosing said printed circuit board and configured to be assembled into the receiving space relatively in a transverse direction and snugly received in the receiving space, and defining a second through hole aligned with the light member in a vertical direction perpendicular to both said printed circuit board and said transverse direction; and a light guide member located between the outer shell and the metallic shell and further completely above the metallic shell in the vertical direction, and comprising a guide portion received in the first through hole; wherein the light guide member receives light from the second through hole and transmits said light to the guide portion in the first through hole.

12. The cable connector assembly as claimed in claim 11, wherein said light guide member is first attached to said outer shell before the metallic shell is snugly received in the receiving space.

13. The cable connector assembly as claimed in claim 11, further including a mating member mounted upon a lateral side of the printed circuit board, wherein said mating member extends parallel to said printed circuit board with a mating opening extending in said transverse direction.

14. The cable connector assembly as claimed in 13, further including a cable with a plurality of wires soldered upon the printed circuit board behind the mating member in said transverse direction, and said light member is located in front of the mating member in a front-to-back direction perpendicular to both said vertical direction and said transverse direction and opposite to said cable.

15. The cable connector assembly as claimed in claim 13, wherein, said metallic shell includes means to secure to the mating member and means to secure to the outer shell.

* * * * *